US011944224B2

(12) United States Patent
Smith et al.

(10) Patent No.: US 11,944,224 B2
(45) Date of Patent: Apr. 2, 2024

(54) ADJUSTABLE CURTAIN MOUNTING ASSEMBLY

(71) Applicants: Melissa Smith, Seattle, WA (US); Amanda Zila, Brentwood, TN (US)

(72) Inventors: Melissa Smith, Seattle, WA (US); Amanda Zila, Brentwood, TN (US)

(73) Assignee: Otterspace, LLC, Seattle, WA (US)

( * ) Notice: Subject to any disclaimer, the term of this patent is extended or adjusted under 35 U.S.C. 154(b) by 37 days.

(21) Appl. No.: 17/824,829

(22) Filed: May 25, 2022

(65) Prior Publication Data

US 2022/0378238 A1 Dec. 1, 2022

Related U.S. Application Data

(60) Provisional application No. 63/193,524, filed on May 26, 2021.

(51) Int. Cl.
*A47H 1/122* (2006.01)
*A47H 1/102* (2006.01)

(52) U.S. Cl.
CPC ..... *A47H 1/122* (2013.01); *A47H 1/102* (2013.01)

(58) Field of Classification Search
CPC ..... A47H 1/122; A47H 1/102; A47H 1/18; A47H 19/00; A47H 2201/00; A47H 2023/003
See application file for complete search history.

(56) References Cited

U.S. PATENT DOCUMENTS 2,864,096 A * 12/1958 Garber ..... A47K 3/38 4/558
3,365,684 A * 1/1968 Stemke ..... H01F 7/0252 160/349.2
5,517,722 A * 5/1996 Bender ..... A47H 19/00 160/349.2
6,094,755 A * 8/2000 Matta ..... A47K 3/38 4/558
6,298,526 B1 * 10/2001 Baumdicker ..... A44B 99/00 24/716
7,644,453 B2 * 1/2010 Dyckow ..... A47K 3/38 4/609
2008/0283202 A1 * 11/2008 Serio, III ..... A47H 1/06 29/700

* cited by examiner

*Primary Examiner* — Anita M King
(74) *Attorney, Agent, or Firm* — TBillick Law PLLC; Timothy J. Billick

(57) ABSTRACT

An adjustable curtain mounting assembly covers a window assembly and comprises a mounting plate adapted to be attachable to the window assembly, a backer, and a first attachment element releasably attaching the backer to the mounting plate, a curtain attachable to the window assembly, and a cover having a second attachment element releasably attaching the cover to the backer. The backer is positioned between the cover and the mounting plate, and the curtain is positioned between the cover and the backer, and the cover, the backer and the mounting plate area cooperate to resist relative movement of the curtain with respect to the window assembly.

19 Claims, 9 Drawing Sheets

ADJUSTABLE CURTAIN MOUNTING ASSEMBLY

This patent application claims priority benefit of U.S. provisional patent application 63/193,524, filed on May 26, 2021.

FIELD OF THE INVENTION

This invention relates to devices for adjustable curtain mounting assemblies, and more particularly to an adjustable curtain mounting assembly suitable for use with blackout curtains.

BACKGROUND OF THE INVENTION

The most common uses of curtains on windows are to provide aesthetic appeal, prevent light from entering the room, and to insulate the room from extreme temperatures and noise. Curtains are typically made out of a fabric and may be installed through a variety of hardware. This hardware may include a permanently installed rod, a removable tension rod, or a track with clips. However, such hardware can cause damage to the wall or window frame. Moreover, the presence of light can interfere with sleep. One known curtain blackout system uses a traditional method of hanging the drapery, with a rod or clips to attach the drapery to hardware that has been permanently installed in the wall surrounding the window frame. In order to increase light blockage, the fabric used is often lined with an opaque material. Even with the application of such hardware, light may not be fully blocked from entering the room due to small gaps between the window and the curtain.

Some solutions for attempting to create a blackout window use adhesives, suction cups, magnets, or hook and loop fasteners in order to apply the curtain directly to the window. Often this either still has gaps through which light comes through or requires that users cut the curtain material to fit the intended window precisely. This makes the use of the same curtain on other windows of different sizes impossible, requiring the purchase of multiple curtains. Additionally, such designs force the user to have to completely remove the curtain from the window if they wish to allow light into the room outside of sleeping hours. The user then has to reapply and adjust the curtain each time they require light elimination.

It would therefore be desirable to provide an adjustable curtain mounting assembly that covers a window assembly and which is relatively easy to install and adjust.

SUMMARY OF THE INVENTION

In accordance with a first aspect, an adjustable curtain mounting assembly covers a window assembly and comprises a mounting plate adapted to be attachable to the window assembly, a backer, and a first attachment element releasably attaching the backer to the mounting plate, a curtain attachable to the window assembly, and a cover having a second attachment element releasably attaching the cover to the backer. The backer is positioned between the cover and the mounting plate, and the curtain is positioned between the cover and the backer, and the cover, the backer and the mounting plate area cooperate to resist relative movement of the curtain with respect to the window assembly.

From the foregoing disclosure and the following more detailed description of various embodiments, it will be apparent to those skilled in the art that the present invention provides a significant advance in the technology of adjustable curtains. Particularly significant in this regard is the potential the invention affords for providing a low-cost, easy-to-use device for adjustably mounting a curtain to a window assembly. Additional elements and advantages of various embodiments will be better understood in view of the detailed description provided below.

Figure 1:
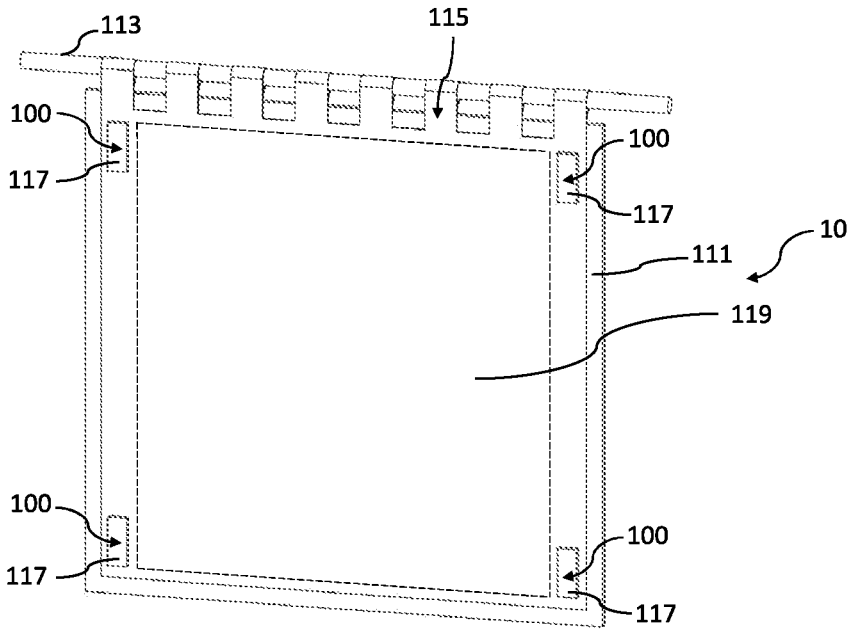
FIG. 1 is an isometric view of a window assembly having an adjustable curtain mounting assembly in accordance with one embodiment, showing four adjustable curtain mounting assemblies attached to a curtain that covers a window.

It should be understood that the appended drawings are not necessarily to scale, presenting a somewhat simplified representation of various features illustrative of the basic principles of the invention. The specific design features of the adjustable curtain mounting assembly as disclosed here, including, for example, the specific dimensions of the cover and the backer, will be determined in part by the particular intended application and use environment. Certain features of the illustrated embodiments have been enlarged or distorted relative to others to help provide a clear understanding. In particular, thin features may be thickened, for example, for clarity of illustration. All references to direction and position, unless otherwise indicated, refer to the orientation illustrated in the drawings.

DETAILED DESCRIPTION OF CERTAIN EMBODIMENTS

It will be apparent to those skilled in the art, that is, to those who have knowledge or experience in this area of technology, that many uses and design variations are possible for the adjustable curtain mounting assembly disclosed here. The following detailed discussion of various alternate elements and embodiments will illustrate the general principles of the invention with reference to an adjustable curtain suitable for blackout windows, that is, windows where the curtain covers all of the windows so as to prevent light from passing beyond the curtain. Other embodiments suitable for other applications will be apparent to those skilled in the art given the benefit of this disclosure.

Turning now to the drawings, FIG. 1 shows how an adjustable curtain mounting assembly 10 covers a window assembly. The adjustable curtain mounting assembly allows for the window covering/curtain 115 to be mounted to a window 119 in order to control light, sound, and/or temperature on the curtain side of the window. The window assembly normally comprises the window 119 and a window frame 111. The curtain 115 can be mounted over the window assembly with a curtain rod 113, for example. At least one adjustable curtain mounting assembly 100 is attached to the window assembly. In FIG. 1, there are four, with each attached to near a corner of the window assembly at the window frame. As discussed in greater detail below, each adjustable curtain mounting assembly is formed from a series of pieces that non-destructively and reversibly hold the curtain in place with respect to the window. This connection is reversible, allowing for the curtain to be detached and pushed to the side in the event that the user wishes to let light in through the window. The adjustable curtain mounting assembly can be easily moved between windows, in addition to flexibly conforming to a wide range of window sizes and shapes. Advantageously, the adjustable curtain mounting assembly allows for the curtain to be mounted snugly against the window, greatly reducing the presence of light in a room.

Figure 2:
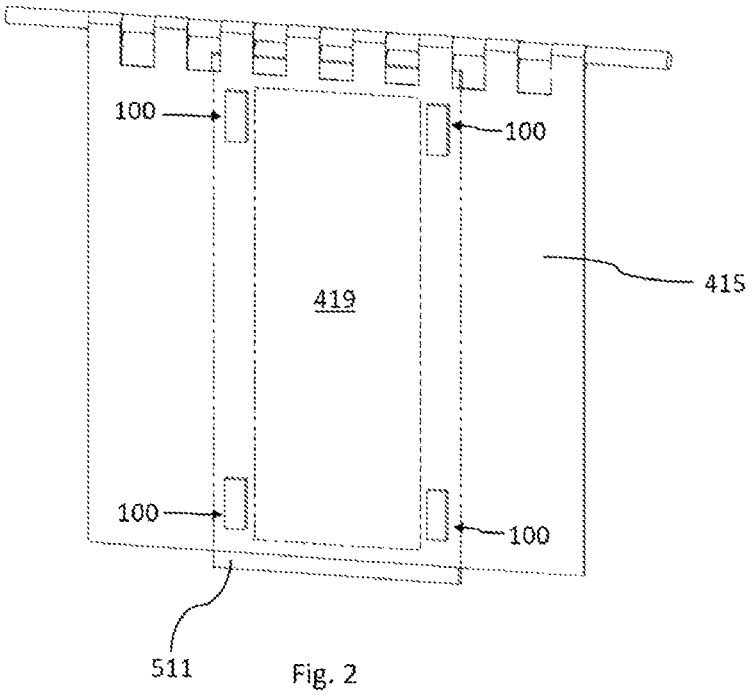
FIG. 2 shows another embodiment of the adjustable curtain mounting assembly where the window assembly comprises a relatively small central window showing how the adjustable curtain mounting assembly in cooperation with the curtain can be used to cover window assemblies of different sizes.

FIG. 2 shows another embodiment where a window assembly has been modified to show a window assembly formed as a smaller window 419, and the 415 curtain may cooperate with the adjustable curtain mounting assemblies 100 to close off a center window by mounting the adjustable curtain mounting assemblies on a window frame at several locations, as shown. That is the window assembly comprises a window frame 511 which partitions the window assembly into a smaller window or multiple smaller windows. Curtain 415 can cover at least the central window 419. Adjustable curtain mounting assemblies 100 may be attached to the window frame as shown. This embodiment advantageously allows for standardization—the curtain can be the same size to cover window assemblies of several different sizes, optionally including window assemblies having multiple windows.

Figure 3:
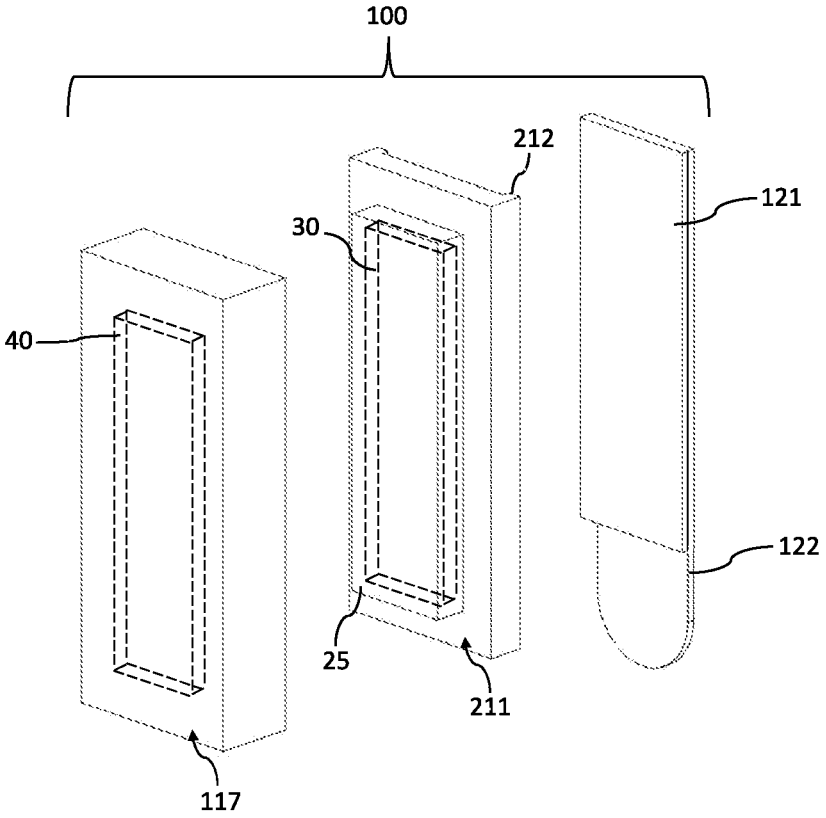
FIG. 3 is an exploded isometric view of an adjustable curtain mounting assembly in accordance with one embodiment using magnetic materials to operatively connect to the window.

FIG. 3 is an exploded view of one embodiment of the adjustable curtain mounting assembly 100, showing a cover 117, a backer 211, and a mounting plate 121. A first attachment element can releasably attach the backer to the mounting plate. The first attachment element between the backer and the mounting plate can be, for example, a clamp, snap buttons, magnetic button clasps or other magnetic materials, hook and loop fasteners, suction cups, or fabric piercing hooks, which releasably holds the backer to the mounting plate. Since the mounting plate is attached to the window assembly, attachment of the backer to the mounting plate, in turn, holds the backer (and items attached to the backer) in place with respect to the window assembly. Alternatively, the mounting plate can be removed and the first attachment element (such as suction cups) may be attached directly to the backer and the window assembly, as discussed in greater detail in FIG. 9 below.

In a similar manner, a second attachment element can releasably attach the cover to the backer. The second attachment element between the backer and the cover can be, for example, a clamp, snap buttons, magnetic button clasps or other magnetic materials, fabric piercing hooks, or magnetic materials which releasably hold the cover to the backer. Since the backer is attached to the mounting plate, attachment of the cover to the backer, in turn, holds the cover (and items attached to the cover) in place with respect to the window assembly.

In the embodiment of FIG. 3, the first attachment element and the second attachment element are both magnetic materials. More specifically, the cover 117 has a cover magnetic material 40, the backer has a backer magnetic material 30, and the mounting plate has a mounting plate magnetic material. At least one of the cover magnetic materials, the backer magnetic material, and the mounting plate magnetic material is a magnet, and there can be more than one magnet used in the assembly. Otherwise, the magnetic material can be a ferrous material such as a steel plate. In the embodiment of FIG. 2, the backer magnetic material 30 is a permanent magnet, and the cover material 40, and the mounting plate magnetic material can comprise steel. The mounting plate 121 has an adhesive tape 122 for rigidly attaching to either the window frame (as shown in FIG. 1) or to the window or wall that the window assembly is mounted on. The mounting plate 121 can be mounted to the window assembly via suction cup pad, vacuum suction cups, permanent adhesive, permanent fasteners, Scotch, hook and loop fasteners, bluestick, electronically controlled magnet lock, etc. Other ways to attach the mounting plate to the window assembly will be readily apparent to those skilled in the art given the benefit of this disclosure. The cover 117, backer 211, and mounting plate 121 are shown as rectangular, but may be other shapes such as a circle, a square, a triangle, or other geometric or abstract shapes.

The window curtain/covering 115 may comprise one or multiple panels of a variety of materials, including, but not limited to: fabrics made from cotton, bamboo, silk, wool, polyester, silk, flax, nylon, rayon, acrylic, lyocell, etc., positioned on an anterior side of the window assembly. Typically, the mounting plate is rigidly affixed to the window assembly, the backer and the cover cooperate to sandwich the curtain, and the backer is reversibly attached to the mounting plate. To provide enhanced blockage of light, a blackout material may be used. Blackout materials may comprise multiple layers of fabrics or may be composed of a fabric that is coated with an opaque membrane and/or one or more layers of acrylic foam. In various aspects, any material which blocks light, sound, and/or regulates temperature, may be used. Also, the window covering 115 may include a pocket, grommets, tabs, ties, hooks, clips, etc. as needed to help hang onto a rod 113 (or rail system). When assembled, the curtain is positioned between the cover and the backer, advantageously enhancing aesthetics, such that only the cover is visible from the interior side of the window assembly (as shown in FIG. 1).

The cover magnetic material 40 and the backer magnetic material 30 may comprise just their corresponding magnetic material, or they can be partially surrounded or entirely surrounded by other materials. The other materials surrounding the magnetic materials advantageously allow for more complex geometry, which can enhance attachment, provide aesthetically appealing show surfaces, and/or protect the magnetic materials (especially permanent magnets, which are brittle). See in FIG. 3, for example, where the backer has a rearward extending flange 212 which defines a backer pocket adapted to receive the mounting plate 121 when assembled together. In particular, when assembled the back flange 212 can be a circumferential flange that extends rearwardly from the backer 211 toward the mounting plate 121 and surround the mounting plate 121. Holding together the cover 117/curtain 115/backer 211/mounting plate 121 by magnet force advantageously makes the cover/curtain/backer releasable with respect to the mounting plate. Also, the cover and the backer can be separated from the curtain. The position and strength of the magnet(s) and/or magnetic materials used can be fine-tuned as needed. For example, the magnetic force between the cover and the backer may be greater than the magnetic force between the backer and the mounting plate. Assembly of the curtain 115 to the window assembly is a straightforward matter. The mounting plate 121 and backer are attached to the window assembly (or wall). Once the backer is close enough, the magnetic attraction is sufficient to operatively and releasably connect the backer to the mounting plate. The curtain is placed over the backer, and then the cover is placed over the curtain to align with the backer (with the curtain sandwiched between the cover and the backer). The whole process is reversible by providing sufficient mechanical force to separate the backer from the mounting plate. Sufficient mechanical force will also allow for separation of the cover 117 from the backer 211.

Figure 4:
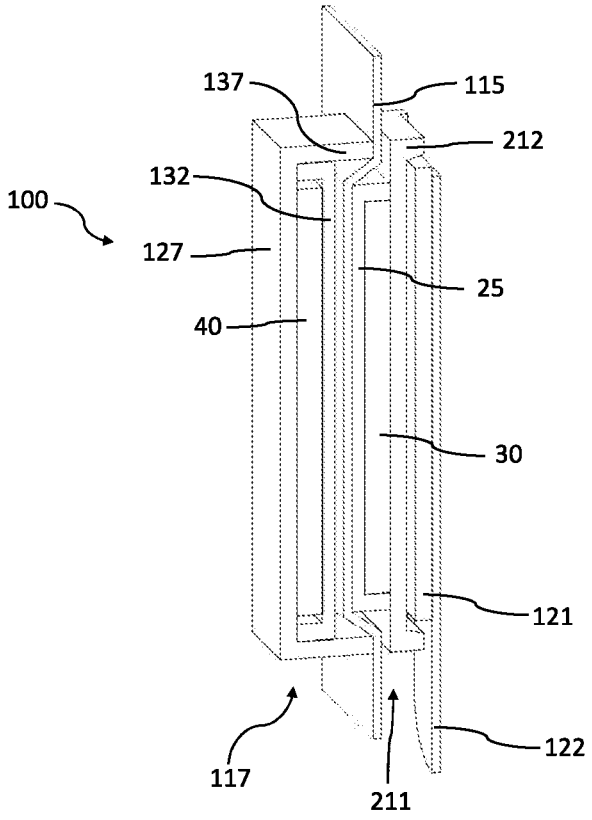
FIG. 4 is an assembled partial isometric view of the adjustable curtain mounting assembly shown mounted on the curtain.

FIG. 4 shows the cover 117/curtain 115/backer 211 and mounting plate 121 assembled together. Movement of the window covering hardware (cover 117 and backer 211) in relation to the window covering 115 is restricted through the use of magnets, magnetic materials, and an interlocking design. In this embodiment, the cover is formed from a cover magnetic material 40, a cover show surface part 127, and a back piece 132 of the cover. The show surface part 127 and the back piece 132 of cover 117 may be connected with fasteners or sonically welded, or connected through permanent adhesives such as wood glue, epoxies, acrylic adhesives, urethane adhesives, for example. Alternatively, these two parts may be formed as a unitary piece, optionally by injection molding a resin around the corresponding magnetic materials. Elements 25 and 212 of the backer 211 may be connected together and surround backer magnetic material in a manner similar to the elements that form the cover. Magnetic force operates to pull the cover and the backer together, releasably holding the curtain 115. Optionally, the cover can be provided with a rearward extending flange 137 (preferably a circumferential flange), and the backer has a forward or anterior extending portion 25 such that the rearward extending flange 137 of the cover extends at least toward the backer, and optionally beyond the backer and around the portion 25 of the backer (while allowing room for the curtain). This has at least the effect of pinching the curtain, as is shown by the bends in the curtain 115 in FIG. 3. Further, backer 211 has the rearward extending flange 212, optionally a circumferential flange which is shown to surround the mounting plate 121. This "interlocking fit" helps resist lateral relative movement and helps to secure the backer to the mounting plate by positioning these two parts close enough together that they are releasably held together by magnetic forces.

Figure 5:
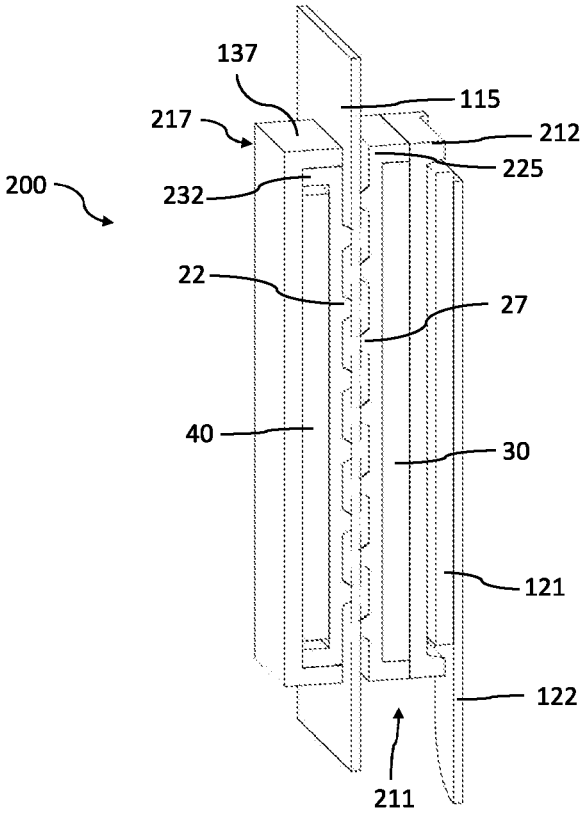
FIG. 5 is an alternate embodiment of the adjustable curtain mounting assembly showing projections that help secure the curtain between a cover and a backer.

FIG. 5 shows another embodiment of an adjustable curtain mounting assembly 200. In this case, a plurality of cover projections 22 extend rearwardly from the back part 232 of the cover 217 towards the curtain 115 and backer 211, and a plurality of backer projections 27 from portion 225 of the backer 211 extend forward toward the curtain 115 and the cover 217. In FIG. 5, the projections 22, and 27 are formed circumferentially around the cover and the backer, respectively. As before the backer engages the mounting plate 121, and the mounting plate is adapted to be attached to the window assembly (typically the frame of the window assembly). The projections cooperate to engage or pinch (resiliently deform) the curtain and to cooperate with the magnetic materials (40, 30) to releasably hold the curtain 115 in place with respect to the window assembly.

Figure 6:
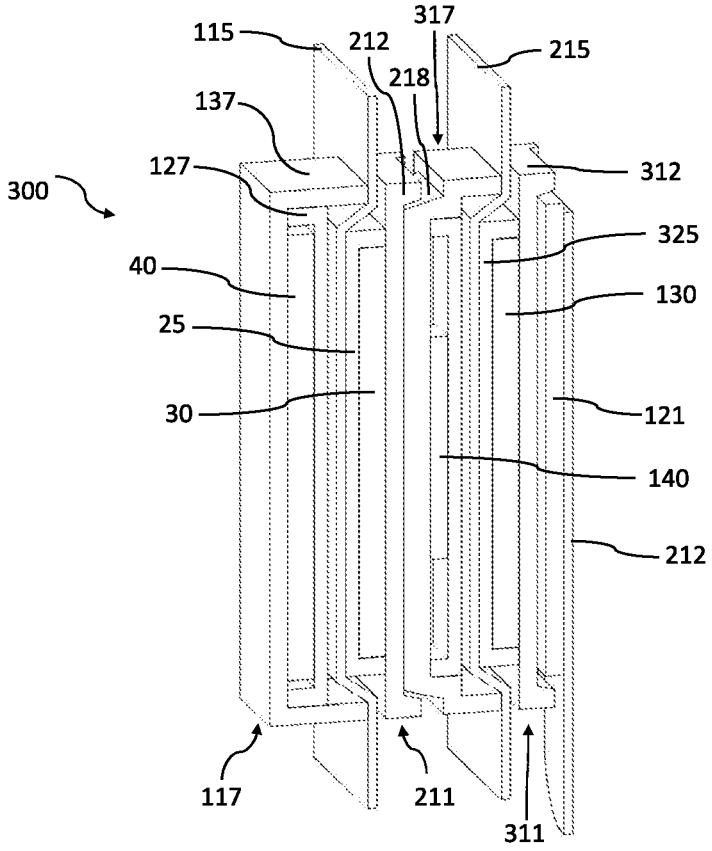
FIG. 6 is another alternate embodiment of an adjustable curtain mounting assembly showing a pair of curtains, a second cover, and a second backer.

FIG. 6 shows another embodiment of the adjustable curtain mounting assembly 300 shown where a pair of curtains (first curtain 115 and second curtain 215) overlap. In this case, there is the first cover 117, and a second cover 317, along with the first backer 211 and a second backer 311 having forward portion 325 similar to forward portion 25 on the first backer. The first curtain 115 and the second curtain 215 cooperate to cover the window assembly, and finally the mounting plate 121. The second cover 317 has a second cover magnetic material 140 similar to the first cover magnetic material 40, and the second backer 311 has a second backer magnetic material 130 similar to magnetic material 30 in the first backer. A stack-up order is first cover 117, then first curtain 115, followed by first backer 211 (with the first cover 117 and the first backer cooperating to hold the first curtain in place), followed by the second cover 317, the second curtain 215, the second backer 311, and then the mounting plate 121 which would be attached to the window assembly. Thus, when two curtains overlap a second mounting assembly is not required.

When the first backer 211 and the second backer 312 are substantially identical, and the first backer 211 is positioned adjacent to the second cover 317, then the second cover (which can be otherwise the same as the first cover) should be provided with a channel or undercut 218 adapted to receive the rearward facing flange 212 of the first backer. As shown in FIG. 6, the flange 212 can be a circumferential back flange. This allows the flange 212 to operatively surround the second cover so as to cooperate with the magnetic material to resist relative movement of the curtains with respect to the window assembly. The second backer 311 defines a pocket adapted to receive the mounting plate 121 in a similar manner to the way the first backer engages the mounting plate 121 in other embodiments.

Figure 7:
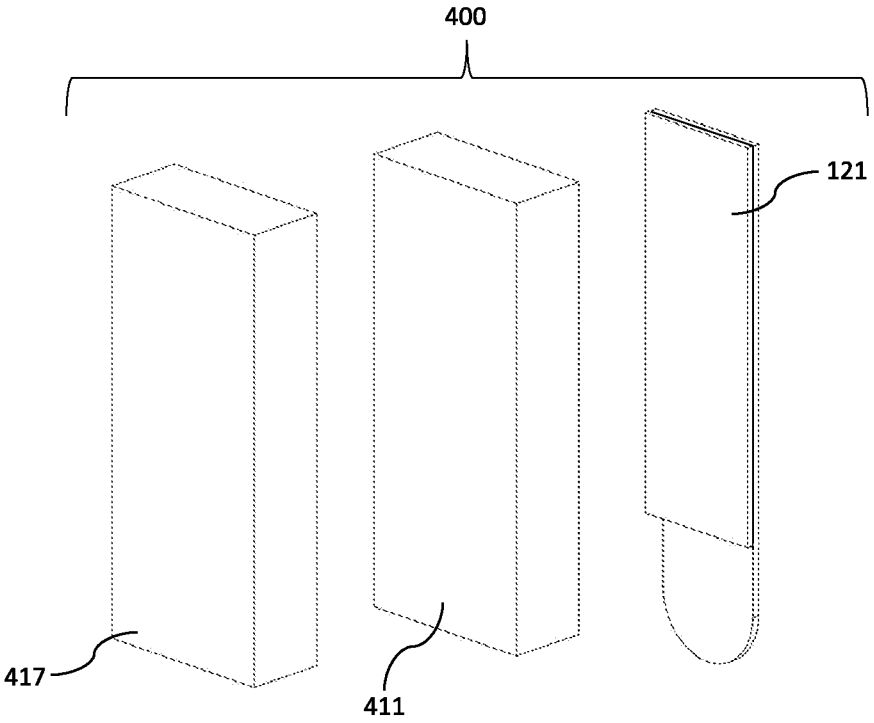
FIG. 7 is an exploded view of another embodiment of the adjustable curtain mounting assembly shown with a pair of magnets and a mounting plate.

FIG. 7 shows a simplified embodiment 400 where the cover 417 is rectangular (cuboid), the backer 411 is rectangular (cuboid) and the mounting plate 121 is as before. The magnetic material of both the cover magnetic material and the backer magnetic material may be magnets or just one of them. The magnetic material of the cover, the backer and/or the mounting plate, may be encapsulated, or optionally, these elements may be formed solely as the magnetic material, without encapsulation layers. Optionally the sides of the cover and backer can also be coated in materials (such as silicone) that aid in resisting movement of the curtain in between them.

Figure 8:
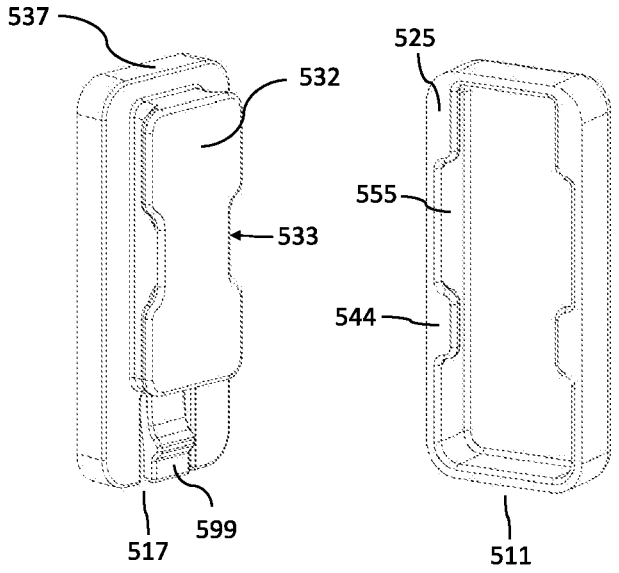
FIG. 8 is another embodiment of the adjustable curtain mounting assembly showing a slidable connection between the cover and the backer.

FIG. 8 shows one further embodiment of an adjustable curtain mounting assembly having cover 517 and backer 511. When assembled the cover 517 and the backer 511 are slidably connected (and releasably connected) to each other, with the curtain sandwiched between them. One way to achieve this is a series of tabs and openings. In FIG. 8 the cover has a cover show surface portion 537, and a back portion 532. These portions may be formed from a resin and be resiliently flexible. The back portion is narrower than the show surface portion, and defines an opening or pocket 533. Similarly, the backer 511 has a portion 525 which defines an opening sized to releasably receive a portion of the curtain and the back portion 532 of the cover 517. The backer portion 525 can have flanges 544 and define openings or pockets 555. The pockets of each element 532 and 525 allow for some clearance during assembly, allowing for the parts to be slidably connected. A resiliently deformable tab 599 may also be provided. Pushing on the tab 599 can deform the aforementioned elements allowing for the cover 517 to be separated from the backer 511 during disassembly. The cover 517 and backer 511 may have magnetic elements in a manner similar to the other embodiments.

Figure 9:
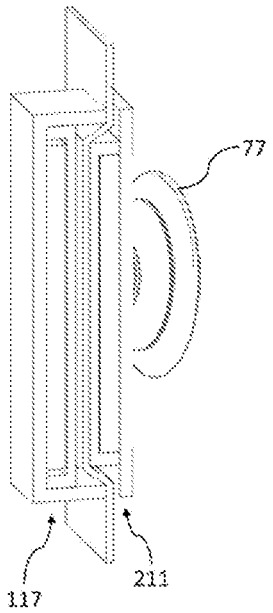
FIG. 9 shows another embodiment where the first attachment element connects the backer to the window assembly.

FIG. 9 shows another embodiment where the mounting plate can be removed and instead the first attachment element (such as suction cups 77) may directly attach the backer 211 to the window assembly. The backer would then be connected to the cover with the curtain sandwiched between the cover and the backer as before. This embodiment also advantageously allows for the ability to move the cover/backer around on the curtain fabric to line up the backer to a desired place on the window assembly to be attached (and also the ability to be readjusted to other window sizes and shapes).

From the foregoing disclosure and detailed description of certain embodiments, it will be apparent that various modifications, additions, and other alternative embodiments are possible without departing from the true scope of the invention. The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An adjustable curtain mounting assembly adapted to cover a window assembly, comprising, in combination:

a mounting plate adapted to be attachable to the window assembly;

a backer, and a first attachment element releasably attaching the backer to the mounting plate;

a curtain adapted to be attachable to the window assembly;

a back flange extends from the backer toward the mounting plate and surrounds the mounting plate to resist lateral movement of the backer with respect to the mounting plate;

a cover, and a second attachment element releasably attaching the cover to the backer;

wherein the backer is positioned between the cover and the mounting plate, and the curtain is positioned between the cover and the backer, and the cover, the backer and the mounting plate area are adapted to cooperate to resist relative movement of the curtain with respect to the window assembly;

the mounting plate has a mounting plate magnetic material; and the backer has a backer magnetic material that cooperates with the mounting plate magnetic material to form the first attachment element so as to make the backer magnetically attachable to the mounting plate.

2. The adjustable curtain mounting assembly of claim 1 wherein the curtain is a blackout curtain and the cover, the backer, and the mounting plate cooperate with the curtain to close an opening between the curtain and the window assembly.

3. The adjustable curtain mounting assembly of claim 1 wherein the backer is slidably connected together with the cover.

4. The adjustable curtain mounting assembly of claim 1 wherein the cover has a cover magnetic material that cooperates with the backer magnetic material to form the second attachment element, so as to make the cover magnetically attachable to the backer.

5. The adjustable curtain mounting assembly of claim 4 wherein at least one of the mounting plate magnetic material, the backer magnetic material, and the cover magnetic material comprises a magnet.

6. The adjustable curtain mounting assembly of claim 4 wherein two of the mounting plate magnetic material, the backer magnetic material, and the cover magnetic material comprises a magnet.

7. The adjustable curtain mounting assembly of claim 4 wherein the backer magnetic material is a magnet.

8. The adjustable curtain mounting assembly of claim 4 wherein the cover magnetic material is a magnet.

9. The adjustable curtain mounting assembly of claim 4 wherein the mounting plate is steel and further comprises a mounting element for attachment to the window assembly comprising one of an adhesive tape, a hook and loop fastener, and a suction cup.

10. The adjustable curtain mounting assembly of claim 4 wherein the mounting plate magnetic material is a magnet.

11. The adjustable curtain mounting assembly of claim 4 wherein the cover is a first cover, the backer is a first backer, and the curtain is a first curtain, and further comprising a second cover, a second backer and a second curtain, wherein:

the first curtain and the second curtain are adapted to cooperate to cover the window assembly, the second curtain is positioned between the second cover and the second backer, and the second cover is positioned between the first backer and the second curtain.

12. The adjustable curtain mounting assembly of claim 11 wherein an undercut is formed at a front of the second cover, and a circumferential back flange from the first backer extends toward the second cover and operatively surrounds the second cover.

13. The adjustable curtain mounting assembly of claim 11 wherein the second backer defines a pocket adapted to receive the mounting plate.

14. The adjustable curtain mounting assembly of claim 11 wherein the second cover has a second cover magnetic material, and the second backer has a second backer magnetic material.

15. An adjustable curtain mounting assembly adapted to cover a window assembly, comprising, in combination:

a mounting plate adapted to be attachable to the window assembly;

a backer, and a first attachment element releasably attaching the backer to the mounting plate;

a curtain adapted to be attachable to the window assembly;

a cover, and a second attachment element releasably attaching the cover to the backer;

wherein the backer is positioned between the cover and the mounting plate, and the curtain is positioned between the cover and the backer, and the cover, the backer and the mounting plate area are adapted to cooperate to resist relative movement of the curtain with respect to the window assembly;

the mounting plate has a mounting plate magnetic material;

the backer has a backer magnetic material that cooperates with the mounting plate magnetic material to form the first attachment element so as to make the backer magnetically attachable to the mounting plate; and the cover has a cover magnetic material that cooperates with the backer magnetic material to form the second attachment element, so as to make the cover magnetically attachable to the backer, and the cover is at least partially surrounded by a cover material, and the backer is at least partially surrounded by a backer material.

16. The adjustable curtain mounting assembly of claim 15 wherein the cover magnetic material is encapsulated, and the backer magnetic material is encapsulated.

17. The adjustable curtain mounting assembly of claim 15 wherein the cover material comprises a cover show surface and a back piece, and has a flange extending from the cover show surface toward the backer which cooperates with the backer to pinch the curtain.

18. The adjustable curtain mounting assembly of claim 15 wherein a plurality of cover projections extend from a back of the cover material toward the backer;

a plurality of backer projections extend from a front of the backer material toward the cover; and the curtain is pinched between the cover projections and the backer projections.

19. An adjustable curtain mounting assembly adapted to cover a window assembly, comprising, in combination:

a mounting plate having a mounting plate magnetic material;

a backer having a backer magnetic material that cooperates with the mounting plate magnetic material to form a first attachment element so as to make the backer magnetically attachable to the mounting plate;

a curtain adapted to be attachable to the window assembly;

a cover having a show surface portion and a back portion, and a second attachment element releasably attaching the cover to the backer, wherein the back portion of the cover further defines a pocket adapted to receive the backer;

wherein the curtain is positioned between the cover and the backer, and the cover, the backer, the first attachment element and the second attachment element are adapted to cooperate to resist relative movement of the curtain with respect to the window assembly.

* * * * *